US006401791B1

(12) United States Patent
Nien

(10) Patent No.: US 6,401,791 B1
(45) Date of Patent: Jun. 11, 2002

(54) VERTICAL BLIND TRACK

(76) Inventor: Ming Nien, No. 11, Kungchu Rd., Fangyuan Industrial Dist., Houliao Village, Fangyuan Hsiang, Changhua Hsien (TW)

( * ) Notice: Subject to any disclaimer, the term of this patent is extended or adjusted under 35 U.S.C. 154(b) by 0 days.

(21) Appl. No.: 09/784,107

(22) Filed: Feb. 16, 2001

(51) Int. Cl.[7] ..... E06B 9/38

(52) U.S. Cl. ..... 160/176.1 V; 160/178.1 V; 269/47; 29/24.5

(58) Field of Search ..... 160/178.1 R, 178.1 V, 160/176.1 R, 176.1, 177 V; 83/54, 178; 269/47; 16/86 R, 86 B

(56) References Cited

U.S. PATENT DOCUMENTS 861,597 A * 7/1907 Merritt
1,642,548 A * 9/1927 Jarecki
5,816,126 A * 10/1998 Pluber
6,009,597 A * 1/2000 Yu
6,073,526 A * 6/2000 Pettersson
6,098,694 A * 8/2000 Ohanesian

* cited by examiner

*Primary Examiner*—Blair M. Johnson
(74) *Attorney, Agent, or Firm*—Rosenberg, Klein & Lee

(57) ABSTRACT

A vertical blind track is inverted U-shaped with a slot defined in the lower portion and includes two end pieces respectively received in opposite ends of the track. Each of the end pieces includes a through hole defined parallel to the track and aligning with each other. A shaft is received in the track and has two opposite ends respectively received in a corresponding end piece. The shaft penetrates multiple clamp devices to clamp the vertical slats. The end piece is made of foam plastic and fully fills the interior space of the track when received in the track to prevent the track from deforming when it is being sawed.

2 Claims, 4 Drawing Sheets

VERTICAL BLIND TRACK

BACKGROUND OF THE INVENTION

1. Field of the Invention

The present invention relates to a vertical blind track, and more particularly to a vertical blind track that includes an end piece installed in the track to prevent the vertical blind track from deforming when the vertical blind tract is cut to an appropriate length.

2. Description of Related Art

With reference to FIGS. 5 and 6, a conventional vertical blind in accordance with the prior art comprises a track (40) adapted to be mounted on a ceiling. The transverse cross section of the track (40) is an inverted U-shape and includes two sides each having a lateral rail (41) formed inwardly on the lower end of the track (40). An end piece (60) is attached to each end of the track (40). A shaft (42) extends through multiple clamps (43) and includes two ends respectively secured in the corresponding end piece (60). The clamp (43) is slidably mounted on the rail (41) in the track (40) and clamps a vertical slat (50). A hook (70) is mounted on each end piece (60) to hold the nearest clamp (43) in place.

In practice, when the length of the track (40) is longer than the width of the window, the seller will cut the track (40) using a unique device that provides a high quality cut.

However, homeowners usually do not have the unique device at home so they cut the track (40) with an ordinary fine tooth saw. The saw is easily inclined, and the track may be deformed or unevenly cut when the saw passes through the track (40) because the track (40) is hollow causing the saw to bounce when cutting the track (40).

The present invention has arisen to mitigate and/or obviate the disadvantages of the conventional vertical blind track.

SUMMARY OF THE INVENTION

The main objective of the present invention is to provide a vertical blind track that can be cut without undue deformation of the track. The vertical blind track is hollow and adapted to be mounted on a ceiling. An end piece is received in opposite ends of the track to prevent the track from being deformed when it is cut.

Further benefits and advantages of the present invention will become apparent after a careful reading of the detailed description with appropriate reference to the accompanying drawings.

DETAILED DESCRIPTION OF THE INVENTION

Figure 1:
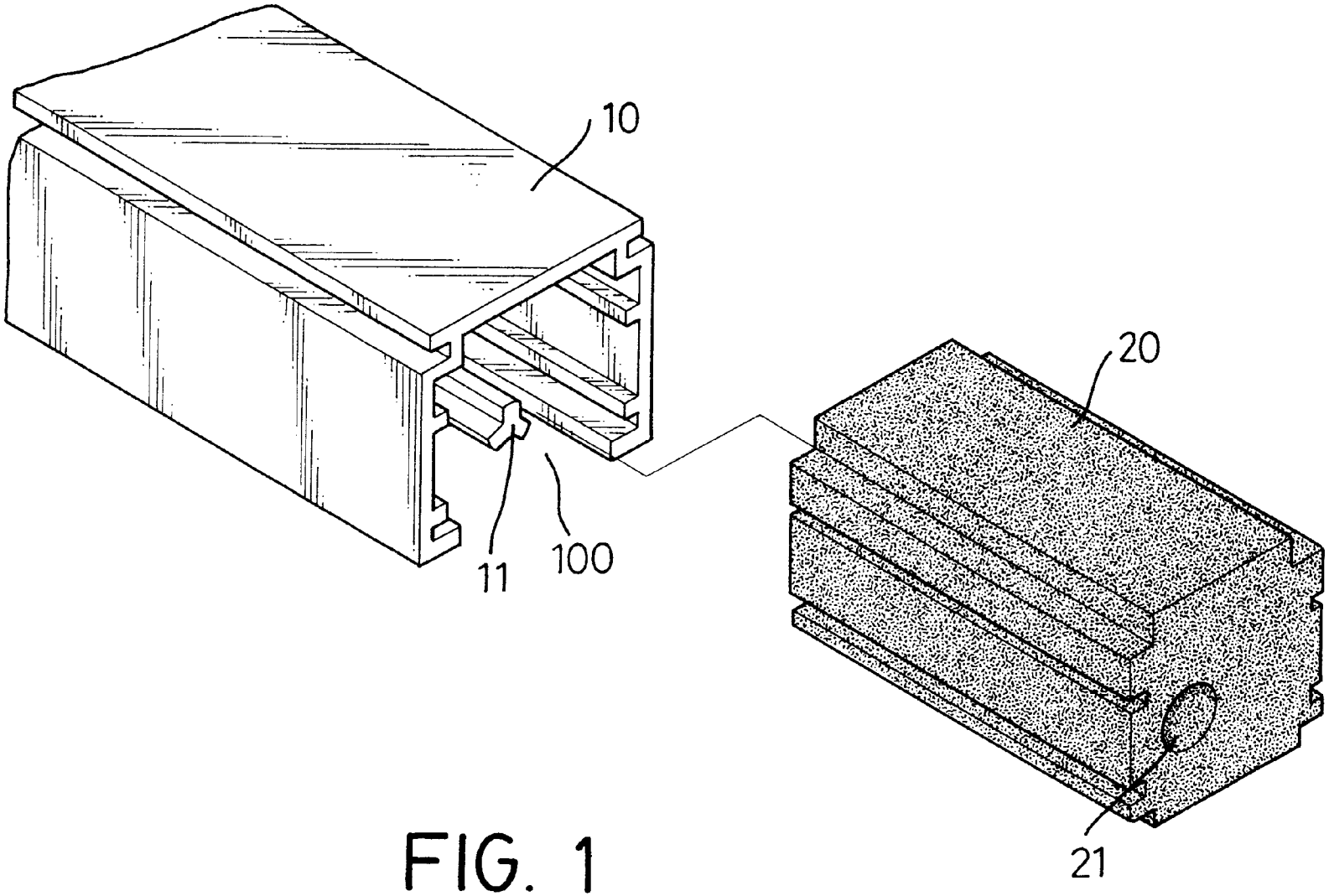
FIG. 1 is an exploded perspective view of a vertical blind track in accordance with the present invention.
Figure 2:
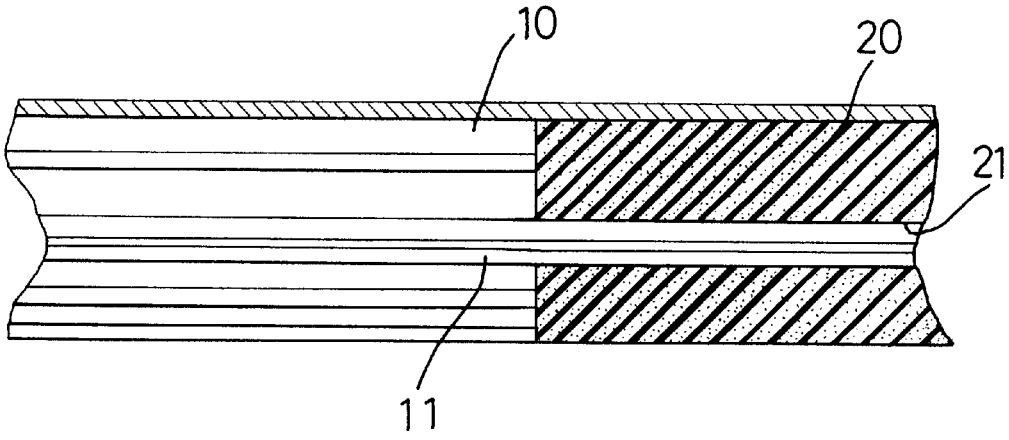
FIG. 2 is a cross sectional front plan view of the track in FIG. 1 with the end piece received in the track.

With reference to the drawings and initially to FIGS. 1 and 2, a vertical blind track (10) in accordance with the present invention is of an inverted U-shape with a slot (100) defined in the lower portion and comprises two end pieces (20) respectively mounted in opposite ends of the track (10). Each of the end pieces (20) includes a through hole (21) defined parallel to the track (10) and aligning with each other. A shaft (11) is received in the track (10) and has two opposite ends respectively received in the corresponding end pieces (21). Multiple clamp devices (not shown) are penetrated by the shaft (11) for clamping vertical slats (not shown).

Figure 3:
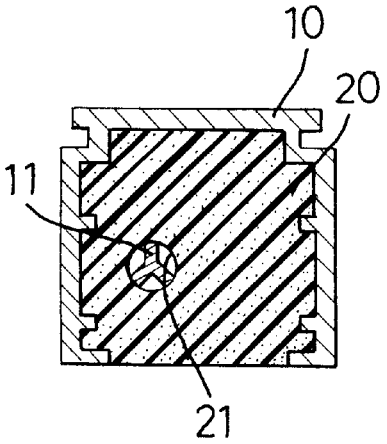
FIG. 3 is a cross sectional side plan view of the track in FIG. 1 with the end piece received in the track.

With reference to FIG. 3, the end piece (20) is made of foam plastic and fully fills the interior space of the track (10) when installed in the track (10) to prevent the track from being deformed when cut. The end piece (20) is flush with the slot (100) in the track (10) after filling the interior space of the track (10).

Figure 4:
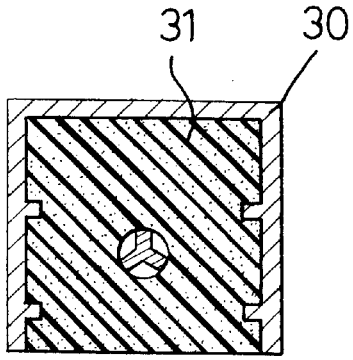
FIG. 4 is a cross sectional side plan view of another embodiment of the track and the end piece received in the track in accordance with the present invention.
Figure 5:
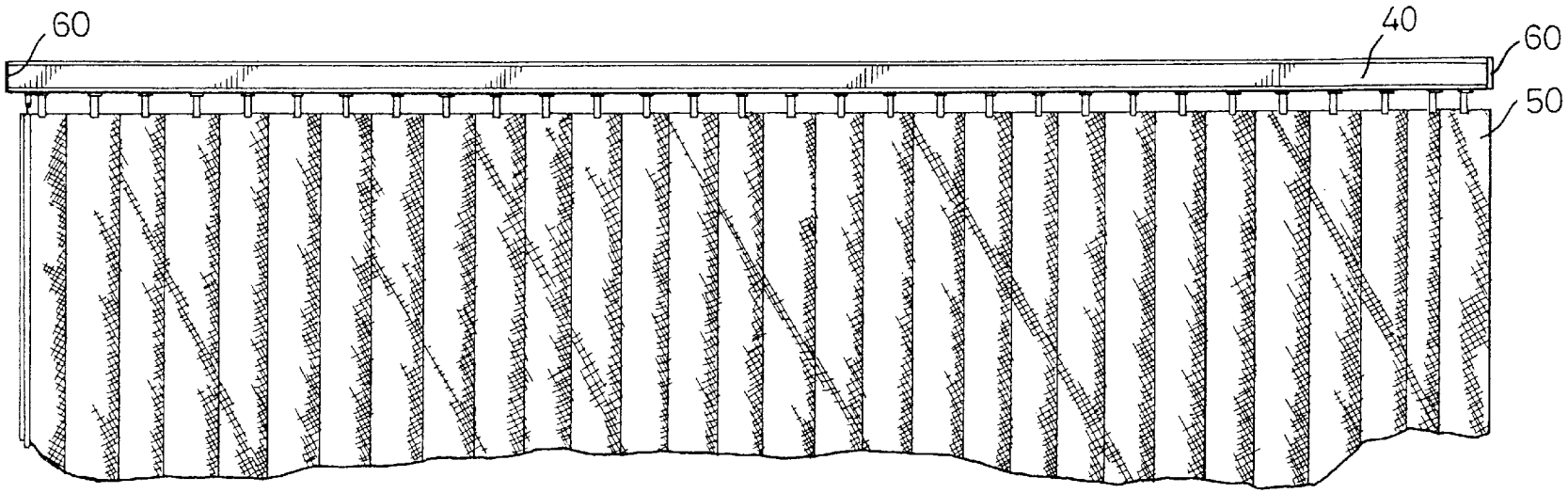
FIG. 5 PRIOR ART
FIG. 5 is a front plan view of a vertical blind in accordance with the prior art.
Figure 6:
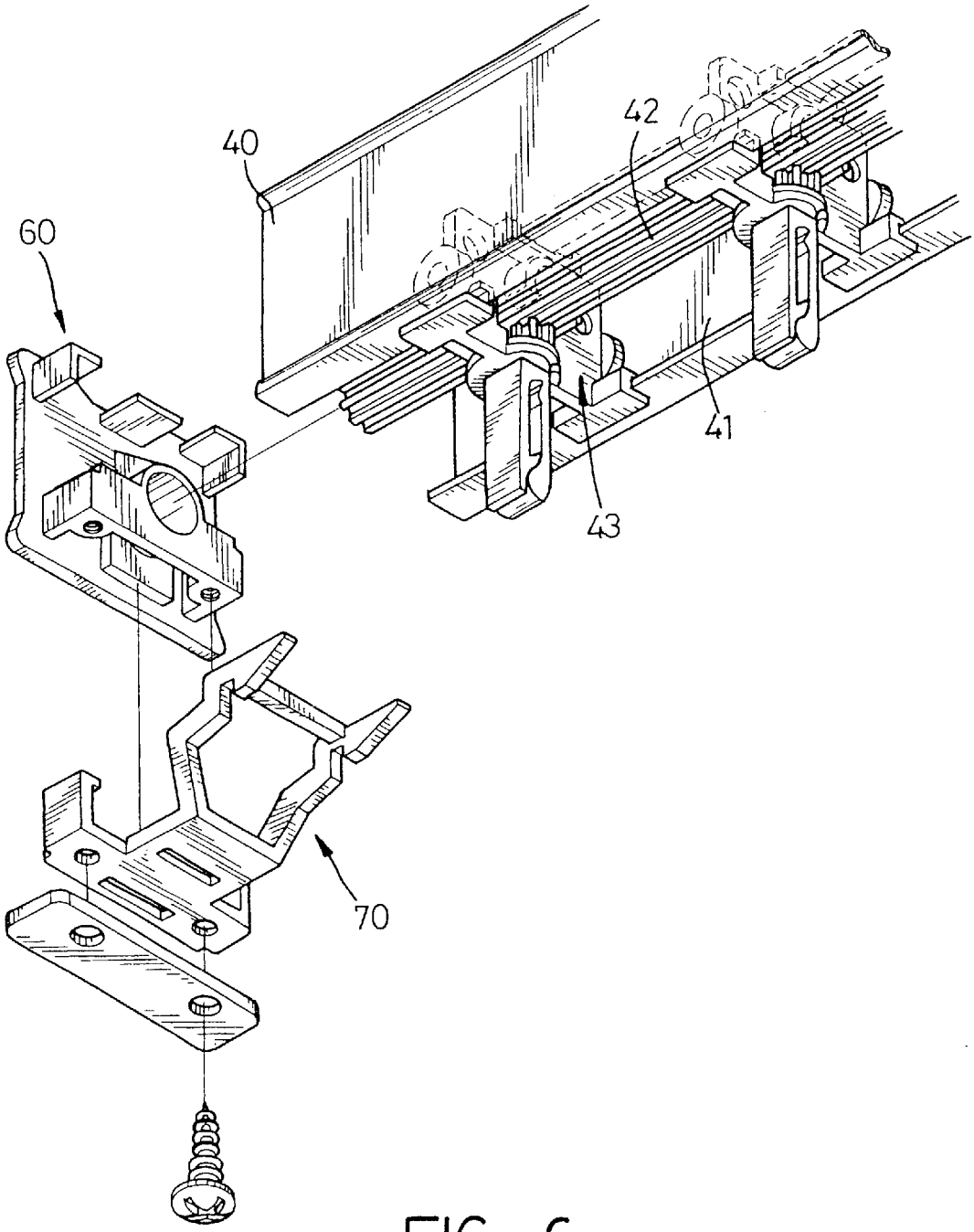
FIG. 6 PRIOR ART
FIG. 6 is a partially exploded perspective view of the conventional vertical blind in FIG. 5.

With reference to FIG. 4, the shape of another embodiment of the end piece (31) in accordance with the present invention is changed due to the shape of the track (30). The track (30) and the end piece (31) are secured together so the customer can saw the track (30) to a suitable length and prevent the track (30) from being deformed during sawing.

Although the invention has been explained in relation to its preferred embodiment, it is to be understood that many other possible modifications and variations can be made without departing from the spirit and scope of the invention as hereinafter claimed.

What is claimed is:

1. A support track apparatus for a vertical blind comprising:

a track having an inner wall surface forming substantially an inverted U-shaped sectional contour to define a longitudinal slot extending between first and second ends, said track including a shaft disposed to extend longitudinally within said slot; and, at least one stationary end piece coupled to each of said first and second ends of said track, each said end piece having formed therein a through hole to receive longitudinally therethrough at least a portion of said shaft of said track, each said end piece engaging in flush manner said inner wall surface at a section of said track to sectionally fill said slot at said track section for internally supporting said track during transverse cutting thereof.

2. The support track apparatus for a vertical blind as recited in claim 1 wherein each said end piece is formed of a foam plastic material.

* * * * *